United States Patent [19]

Wortham

[11] Patent Number: 4,973,802

[45] Date of Patent: Nov. 27, 1990

[54] ROTARY SWITCH ASSEMBLY FOR STAND-MOUNTED APPLIANCE

[75] Inventor: Brent J. Wortham, Pasadena, Calif.

[73] Assignee: Tatung Company of America, Inc., Long Beach, Calif.

[21] Appl. No.: 389,676

[22] Filed: Aug. 4, 1989

[51] Int. Cl.[5] ..... H01H 19/02

[52] U.S. Cl. ..... 200/52 R; 200/567

[58] Field of Search ..... 200/11 R, 60, 61.85, 200/567, 293.1, 332.2, 568–571, 52 R

[56] References Cited

U.S. PATENT DOCUMENTS

| | | | |
|---|---|---|---|
| 2,493,419 | 1/1950 | Puffer | 200/567 |
| 2,690,504 | 9/1954 | Morin | 200/567 X |
| 3,894,207 | 7/1975 | Jelley | 200/567 |

*Primary Examiner*—J. R. Scott

*Attorney, Agent, or Firm*—Gene W. Arant; Don C. Lawrence

[57] ABSTRACT

A rotary switch assembly for use with a stand-mounted appliance includes a conventional rotary switch which is installed through the side of the stand and mounted therein on a plate such that the stem of the switch is coaxially aligned with the long, central axis of the stand. A control knob in the form of a split, annular sleeve is snapped circumferentially around the stand to cover the opening and has an arm which extends radially inward through the opening to grasp the switch's stem such that rotation of the knob about the stand in the circumferential direction produces a corresponding rotation of the stem.

10 Claims, 2 Drawing Sheets

Fig. 2.
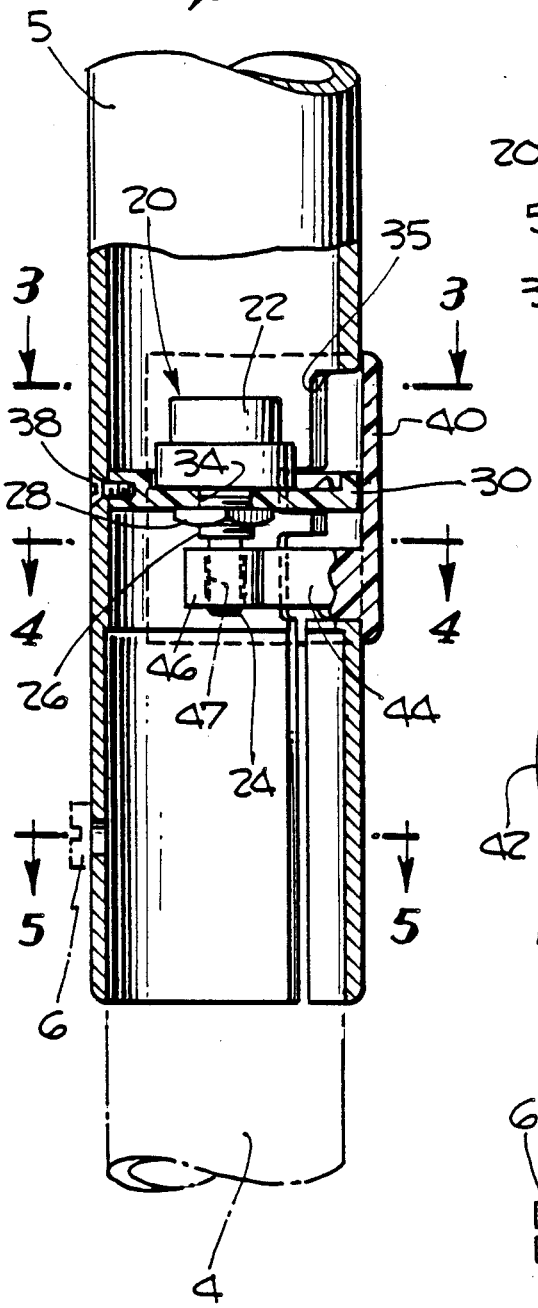
Fig. 3.
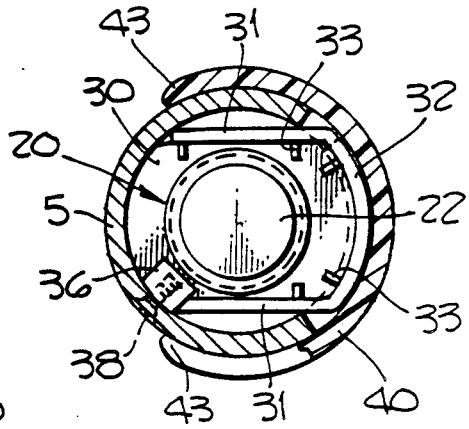
Fig. 4.
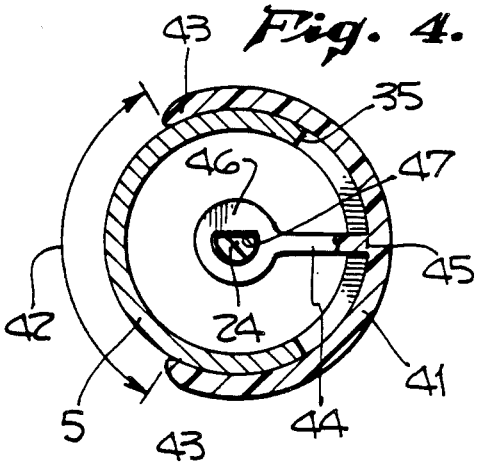
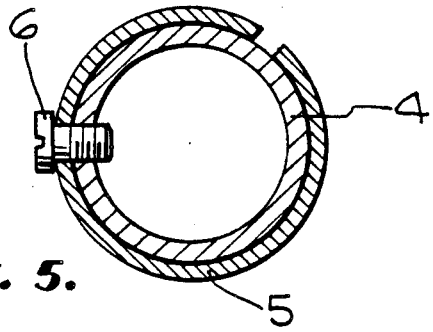
Fig. 5.

ROTARY SWITCH ASSEMBLY FOR STAND-MOUNTED APPLIANCE

BACKGROUND OF THE INVENTION

1. Field of the Invention

This invention pertains, in general, to controls for electrical devices, and in particular, to a rotary switch assembly adapted for use in a stand-mounted appliance, such as a floor fan.

2. Description of the Related Art

Stand-mounted appliances, of which a floor-standing fan is an example, incorporate a support structure which comprises a base member and a single, enlongated tubular stand member extending upwardly from it. A line cord, which is usually introduced through the base or the lower part of the stand, brings electrical power from the wall, through the interior of the hollow stand, and to the appliance located at the top of the stand. A control switch is typically introduced into the cord at some point in its extent to control certain functions of the appliance.

In the past, it has been known to locate one or more push-button switches for controlling, e.g., the speed of the fan, in the base member, or in a box attached to the stand. In another known embodiment, a multi-position rotary switch is mounted on, or in, the appliance's motor housing at the top of the stand.

This invention discloses a new and useful form of a rotary switch assembly for use in such a stand-mounted appliance in which all of the switch structure, except an actuating knob or grip, resides flush within the stand and at a convenient height above the floor, and wherein operation of the appliance is controlled by a simple rotation of a concentric grip or handle about the stand. The switch assembly disclosed herein is relatively inexpensive to make and easy to install.

SUMMARY OF THE INVENTION

The rotary switch assembly of the invention is intended for use with a stand-mounted appliance of the type which includes an elongated, tubular stand having a central axis and a circumferential sidewall.

The assembly includes a conventional rotary switch, preferably of the type which has an annular mounting ring concentric with a rotatable, axial control stem on the switch.

A switch mounting plate has a central aperture in which the switch is axially mounted. The plate is installed inside the stand through an opening in its sidewall in a plane normal to the stand's central axis and adjacent to the opening. Thus, when the plate is installed in the stand, the switch is held therein with its stem coaxially aligned with the stand's central axis.

A control knob, or grip, is provided in the form of a resilient, open-sided sleeve or channel which preferably snaps about the stand in a radial direction and is concentrically retained on it for rotation in the circumferential direction. The grip preferably covers the opening and has an arm on it which extends radially inward through the opening and is connected at an internal end to the stem of the switch such that rotation of the grip about the stand produces rotation of the switch's stem.

A more complete understanding of the invention, along with its many attendant advantages, may be had from a consideration of the detailed description included hereinafter, particularly when considered in light of the accompanying figures, a brief description of which now follows.

BRIEF DESCRIPTION OF THE DRAWINGS

FIG. 2 is a sectional view through the side of the switch assembly, as taken along the line 2—2 in FIG. 1;

FIG. 3 is a cross sectional view through the assembly in the axial direction, as taken along the line 3—3 in FIG. 2;

FIG. 4 is a cross sectional view through the assembly in the axial direction, as taken along the line 4—4 in FIG. 2;

FIG. 5 is a cross sectional view through the assembly in the axial direction, as taken along the line 5—5 in FIG. 2;

DETAILED DESCRIPTION OF THE PREFERRED EMBODIMENTS

Figure 1:
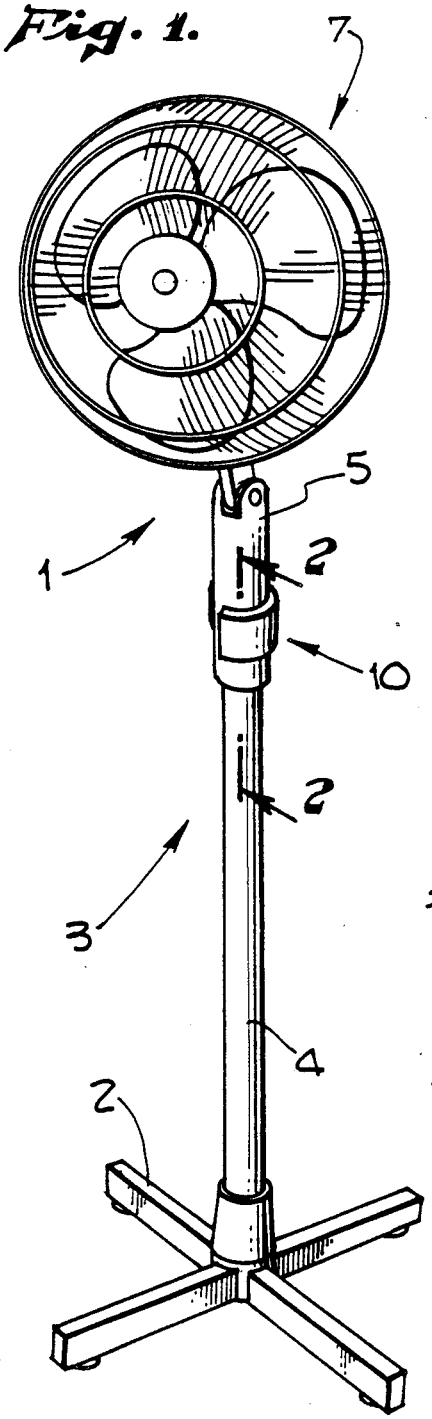
FIG. 1 is an isometric view of a floor-standing fan which incorporates the rotary switch assembly of the present invention.
Figure 6:
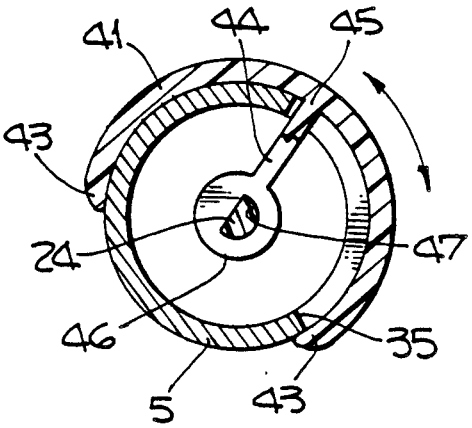
FIG. 6 is a cross sectional view similar to FIG. 4, showing circumferential movement of the knob or grip of the switch assembly in the direction of the arrow.

FIG. 1 illustrates a typical stand-mounted electrical appliance in the form of a floor standing fan 1, within which the present invention is particularly adapted for use. The fan 1 includes a base part 2, and a long, tubular stand member 3 extending upwardly from it.

The stand member 3 may, as illustrated, include a diametrically smaller lower portion 4, with a split, diametrically larger upper portion 5 disposed concentrically on its top end and held in place there with a fastener 6, as illustrated in cross section in FIG. 5. An electric fan 7, comprising a motor, a rotating shaft, and a bladed fan with a guard around it is disposed atop the stand for normal operation.

The upper portion 5 of the stand includes a rotary switch assembly 10 in accordance with the present invention. The assembly 10, when removed from the stand and separated vertically, appears as illustrated in FIG. 7, and comprises a rotary switch 20, a switch mounting plate 30, and a control knob or hand grip portion 40.

Figure 7:
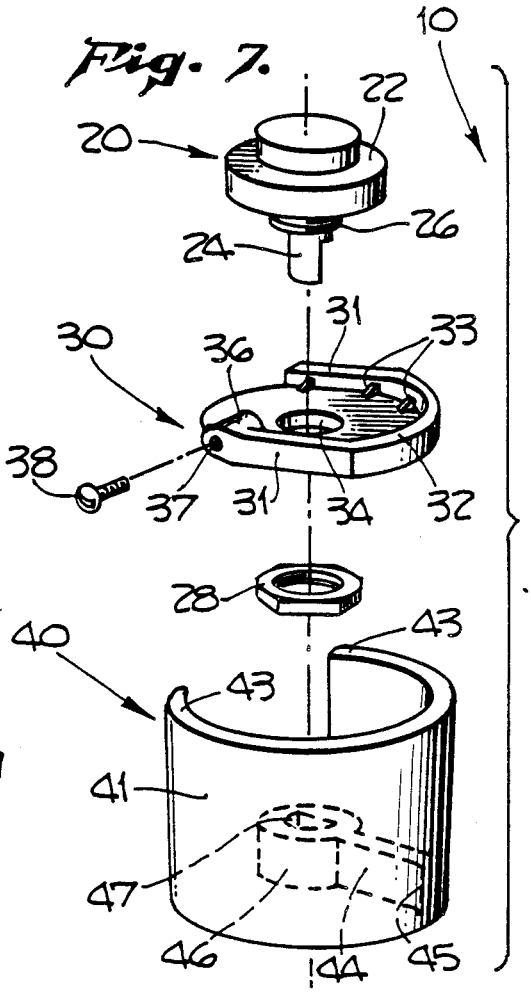
FIG. 7 is an exploded isometric view of the switch assembly of the present invention.

The rotary switch 20 is of a conventional type, and includes a switch body 22, and a control stem 24 which is rotatable about an axis through the switch (see FIGS. 2 and 7). A threaded, annular mounting ring 26 is disposed concentrically about the stem 24. The switch may be mounted to, e.g., a chassis, by inserting the ring through a hole contained in the chassis and then threading a locking nut 28 onto it on the side of the chassis opposite the switch body such that the chassis is sandwiched between them.

The mounting hole is typically keyed to fit a corresponding key or radial lug on the mounting ring to prevent rotation of the switch in the hole. Similarly, the stem of the switch is keyed, e.g., with the D-shaped configuration shown in the drawings, to prevent relative rotation of a control knob or the like which slides on the stem in the axial direction.

Not illustrated are the solder lugs or wire connectors which are typically included on the switch and used to interconnect the power cord electrically with the appliance to be controlled.

The switch mounting plate 30, which may be injection-molded from a thermoplastic, is generally circular in shape, and is sized to fit snugly within the internal bore of the stand. The plate has chamfered sides 31 to permit the plate to be inserted through an opening contained in the side of the stand in the manner described below, and also permits the power cord or wires to pass between the plate and the internal wall surface of the stand after the plate has been installed. An upraised lip 32 with reinforcing gussets 33 are molded in the plate to give it strength and stiffness in the axial direction. The plate 30 contains a central aperture 34 within which the switch 20 is axially mounted in the manner described above. The aperture 34 may also include a molded-in keying feature such as that described.

During installation, the plate 30, containing the mounted switch 20, is inserted into the stand part 5 in the radial direction through an opening 35 contained in the wall of the stand (see FIGS. 2 and 4), and is retained there adjacent to the opening in a plane normal to the stand's central axis such that the stem 24 of the switch is coaxially aligned with the central axis of the stand. For this purpose, the plate includes at least one molded-in mounting boss 36 containing a radially-extending bore 37 which is threaded to receive a plate-installing fastener 38 extending radially through the wall of the stand in the manner illustrated best in FIGS. 2 and 3.

In order to operate the switch 20, a control knob or grip 40 is provided in the assembly. The control knob includes a split, annular sleeve or C-shaped channel 41 formed of a springy, resilient material, such as a thermoplastic, which has a longitudinal seam or opening 42 along its side extending throughout its length (see FIG. 4). The opening defines a pair of opposing, circumferential halves or fingers 43 which can be spread apart to permit the stand 5 to pass between them as the knob is snapped on the stand in a radial direction, and which will then spring back together to retain the knob on the stand.

The knob 40 has an arm 44 extending radially inward into the stand through the opening 35. The arm has an external end 45 attached to the sleeve at a position on its internal circumference opposite the opening 42, and an internal end 46 with means, such as the D-shaped opening 47 illustrated, for sliding the end over the stem 24 and grasping it such that circumferential rotation of the knob about the stand will rotate the stem. The arm, and thus the knob, are retained against axial movement on the stand by the switch at the top of the arm and the lower edge of the opening 35 at the arm's bottom (see FIG. 2).

In the preferred assembly 10, the plate 30, with the switch 20 mounted on it, and the arm 44, with the stem 24 engaged within it, are simultaneously inserted through the opening 35 while the knob 40 is installed about the stand 5, all in the radial direction. This permits the assembly to be installed and uninstalled in the stand without having access to its ends or without having to remove either the fan 7 or the base 1 from it.

Also, in the preferred embodiment illustrated, the opening 35 is sized to permit rotation of the arm 44, and hence the stem 24, through an angle of arc of about 90 degrees, but can be made larger or smaller. The length and circumferential extent of the sleeve 41 is preferably adjusted to completely close the opening 35 for safety reasons and to keep out dirt and the like.

Indeed, it may be seen from the foregoing that many variations are possible in terms of the materials, fabrication and installation of the switch assembly 10 of the present invention. Accordingly, the scope of the invention should be limited only by that of the claims appended hereinafter.

What is claimed is:

1. A rotary switch assembly for a stand-mounted appliance of the type which includes an elongated, tubular stand having a central axis and an opening through its sidewall, comprising:

a switch having a stem rotatable about a switch axis;

a switch-mounting plate having an outer periphery sized to fit transversely within the stand, at least one radially aligned aperture internally adapted to receive and hold an external mounting fastener extending through the sidewall of the stand, and an axially aligned central aperture disposed to receive and mount the switch coaxially with the axis of the stand; and an annular-shaped control knob disposed concentrically about the stand and overlying the opening, the knob having an arm extending radially inward through the opening with means at a central end thereof for engaging the stem of the switch such that circumferential rotation of the knob about the stand results in a corresponding rotation of the stem.

2. The switch assembly of claim 1, wherein the switch, the opening, and the plate are complementarily sized such that the plate, with the switch mounted on it, can be inserted radially through the opening and mounted within the stand.

3. The switch assembly of claim 1, wherein the control knob further includes an open seam extending throughout its length at a circumferential position about opposite the arm, thereby defining a pair of opposing fingers, and wherein the control knob is made of a springy material such that the fingers can be spread apart to pass the stand between them and the knob installed about the stand in a radial direction.

4. The switch assembly of claim 1, wherein the control knob further includes an open seam extending throughout its length at a circumferential position about opposite the arm, thereby defining a pair of opposing fingers, and wherein the control knob is made of a springy material so that the fingers can be spread apart to pass the stand between them and the knob installed about the stand in a radial direction.

5. The switch assembly of claim 2, wherein the control knob further includes an open seam extending throughout its length at a circumferential position about opposite the arm, thereby defining a pair of opposing fingers, and wherein the control knob is made of a springy material so that the fingers can be spread apart to pass the stand between them and the knob installed about the stand in a radial direction, whereby the plate, with the switch mounted on it, and the arm, with the stem engaged in it, can be simultaneously inserted through the opening in a radial direction while the knob is being installed about the stand.

6. A stand-mounted electrical appliance, comprising:

a base;

an elongated tubular stand extending upwardly from the base and having a central axis, a circumferential wall, and an opening extending through the wall;

an electrical appliance mounted atop the stand;

a rotary switch mounted inside the stand, the switch having an axial stem aligned coaxially with the axis of the stand;

a handle comprising a resilient, open-sided sleeve snapped concentrically around the stand and rotatable thereon in the circumferential direction, the sleeve having a length and circumferential extent sufficient to cover the opening; and an arm having an external end attached to the sleeve at a position on its internal circumference about opposite its open side and an internal end projecting radially inward through the opening and connected to the stem of the switch such that rotation of the sleeve in a circumferential direction results in a corresponding rotation of the stem.

7. The appliance of claim 6, further comprising:

a switch mounting plate fixed inside the stand adjacent to the opening in a plane normal to the stand's central axis, the plate having a boss containing a threaded, radially-extending aperture engaged with a fastener extending through the wall of the stand, and a central, switch-mounting aperture coaxially aligned with the stand's central axis, through which the switch is axially mounted.

8. The appliance of claim 6, further comprising:

a switch mounting plate fixed inside the stand adjacent to the opening in a plane normal to the stand's central axis, the plate having a boss containing a threaded, radially-extending aperture engaged with a fastener extending through the wall of the stand, and a central, switch-mounting aperture coaxially aligned with the stand's central axis, through which the switch is axially mounted.

9. The appliance of claim 7, wherein the opening is sized to pass the plate with the switch mounted on it.

10. The appliance of claim 8, wherein the opening is sized to pass the plate with the switch mounted on it.

* * * * *